US011794868B2

(12) United States Patent
Wright et al.

(10) Patent No.: US 11,794,868 B2
(45) Date of Patent: Oct. 24, 2023

(54) HANDLE FOR WINGSURFING WINGS

(71) Applicant: OCEAN RODEO SPORTS INC., Victoria (CA)

(72) Inventors: Peter Wright, Mosier, OR (US); John Bellacera, Bingen, WA (US); Liam McLean, Victoria (CA); Ross Harrington, Victoria (CA)

( * ) Notice: Subject to any disclaimer, the term of this patent is extended or adjusted under 35 U.S.C. 154(b) by 0 days.

(21) Appl. No.: 17/867,978

(22) Filed: Jul. 19, 2022

(65) Prior Publication Data

US 2023/0035554 A1 Feb. 2, 2023

Related U.S. Application Data

(60) Provisional application No. 63/226,440, filed on Jul. 28, 2021.

(51) Int. Cl.
*B63H 8/12* (2020.01)
*B63H 8/16* (2020.01)

(52) U.S. Cl.
CPC ..... *B63H 8/16* (2020.02); *B63H 8/12* (2020.02)

(58) Field of Classification Search
CPC .... B63H 8/16; B63H 8/12; B63H 8/10; A45F 2005/1013
See application file for complete search history.

(56) References Cited

U.S. PATENT DOCUMENTS 11,554,842 B1 * 1/2023 Girardin ..... B63B 32/40
2022/0396341 A1 * 12/2022 Winner ..... B63H 8/10

FOREIGN PATENT DOCUMENTS

DE 202021102914 U1 * 7/2021
DE 102021106993 A1 * 2/2022 ..... B63H 8/12
DE 102021100927 B3 * 3/2022

* cited by examiner

*Primary Examiner* — Andrew Polay

(57) ABSTRACT

A wingsurfing wing, a handle thereof and a method of retaining the handle. The handle includes a member that is elongated in an elongation direction to be suitable for grasping. First and second attachment portions suitable for attaching the member to a strut of the wing extend from the member and are spaced apart from each other in the elongation direction. A fitting defines the second attachment portion and is adjustable between first and second configurations. In the first configuration, the fitting is movably engaged with the member to reposition the second attachment portion in the elongation direction. In the second configuration, the fitting is fixedly engaged with the member. The method includes causing frictional engagement between the strut and the fitting via an interference fit between a fastening portion and the strut, and causing frictional engagement between the fitting and the member to prevent movement of the fitting.

20 Claims, 13 Drawing Sheets

HANDLE FOR WINGSURFING WINGS

CROSS-REFERENCE TO RELATED APPLICATIONS

Any and all priority claims identified in the Application Data Sheet, or any correction thereto, are hereby incorporated by reference under 37 CFR 1.57.

This application claims the benefit of U.S. Provisional Application No. 63/226,440 filed on Jul. 28, 2021. The aforementioned application is incorporated by reference herein in its entirety, and is hereby expressly made a part of this specification.

TECHNICAL FIELD

The disclosure relates generally to wingsurfing wings, and more particularly to handles for wingsurfing wings.

BACKGROUND

The sport of wingsurfing, also referred to as wingboard or wingfoiling, is a fast growing water sport and involves using a wing, which is typically inflatable and includes an inflatable leading edge and strut, to support a canopy creating an airfoil shape. The user, referred to as a wingsurfer or wingboarder, will use this wing and the wind to propel themselves across the water and employ a handle (or a plurality thereof) to hold onto and control the wing. The wing is also commonly harnessed to the user. The handles are affixed to the wing, e.g. by means of sown fasteners or other means, to achieve good responsiveness of the wing when being manipulated via the handle. This is especially important when the wing is experiencing large forces, e.g. due to high winds and/or sudden movements of the user. The form of the handle is particularly important from the perspective of a wingsurfer since it provides the connection to, allows control of, the wing.

Due to the large role played by the wind in the sport, a wingsurfer will use a different sized wing depending on the wind conditions on any given day. Typically, the larger the wing, the larger the handle thereof. Other accessories may also be sized based on the size of the wing.

Due to the variety of wind conditions at any given location, and the attractiveness of practicing the sport at different geographic locations, it is common for users to maintain collections of wings and associated accessories. However, this may be costly. Furthermore, storage and transport of such collections can be inconvenient, particularly when there are parts of wings or accessories thereof that cannot be deflated to reduce overall weight and volume.

SUMMARY

In an aspect, the disclosure describes a wingsurfing handle. The wingsurfing handle also includes a member that is elongated in an elongation direction to be suitable for grasping; a first attachment portion extending from the member; and a fitting defining a second attachment portion that extends from the member and that is spaced apart in the elongation direction from the first attachment portion, the fitting being adjustable between a first configuration and a second configuration, the fitting in the first configuration being movably engaged with the member to reposition the second attachment portion relative to the first attachment portion in the elongation direction, the fitting in the second configuration being fixedly engaged with the member, the first and second attachment portions being suitable for attaching the member to a strut of a wingsurfing wing.

In an aspect, the disclosure describes a wingsurfing wing. The wingsurfing wing also includes a leading edge portion; a trailing edge portion; a strut extending between the leading edge portion and the trailing edge portion; a member connected to the strut at a first location of the strut, the member being elongated in an elongation direction and spaced apart from the strut to be suitable for grasping; and a fitting extending from the member and connecting the member to the strut at a second location of the strut spaced apart from the first location in the elongation direction, the fitting being adjustable between a first configuration and a second configuration, the fitting in the first configuration being movably engaged with the member to allow movement of the fitting in the elongation direction to vary the second location, the fitting in the second configuration being fixedly engaged with the member.

In an aspect, the disclosure describes an adjustable fitting for a wing handle. The adjustable fitting also includes a first attachment portion suitable for attaching the adjustable fitting to a strut of the wing; a girdle attached to the first attachment portion and adapted to receive a member of the handle for slidable engagement with the member in a first configuration to allow repositioning of the adjustable fitting relative to a second attachment portion of the handle in an elongation direction, the member being elongated in the elongation direction to be suitable for grasping; and one or more frictional surfaces extending radially inwardly from the girdle to frictionally engage the member to hinder slidable engagement between the girdle and the member when the adjustable fitting is in a second configuration, the girdle being adjustable from the first configuration to the second configuration by rotation of the girdle to push the one or more frictional surfaces into the member of the handle. Embodiments can include combinations of the above features.

Further details of these and other aspects of the subject matter of this application will be apparent from the detailed description included below and the drawings.

BRIEF DESCRIPTION OF THE DRAWINGS

Reference is now made to the accompanying drawings, in which.

DETAILED DESCRIPTION

Figure 1A:
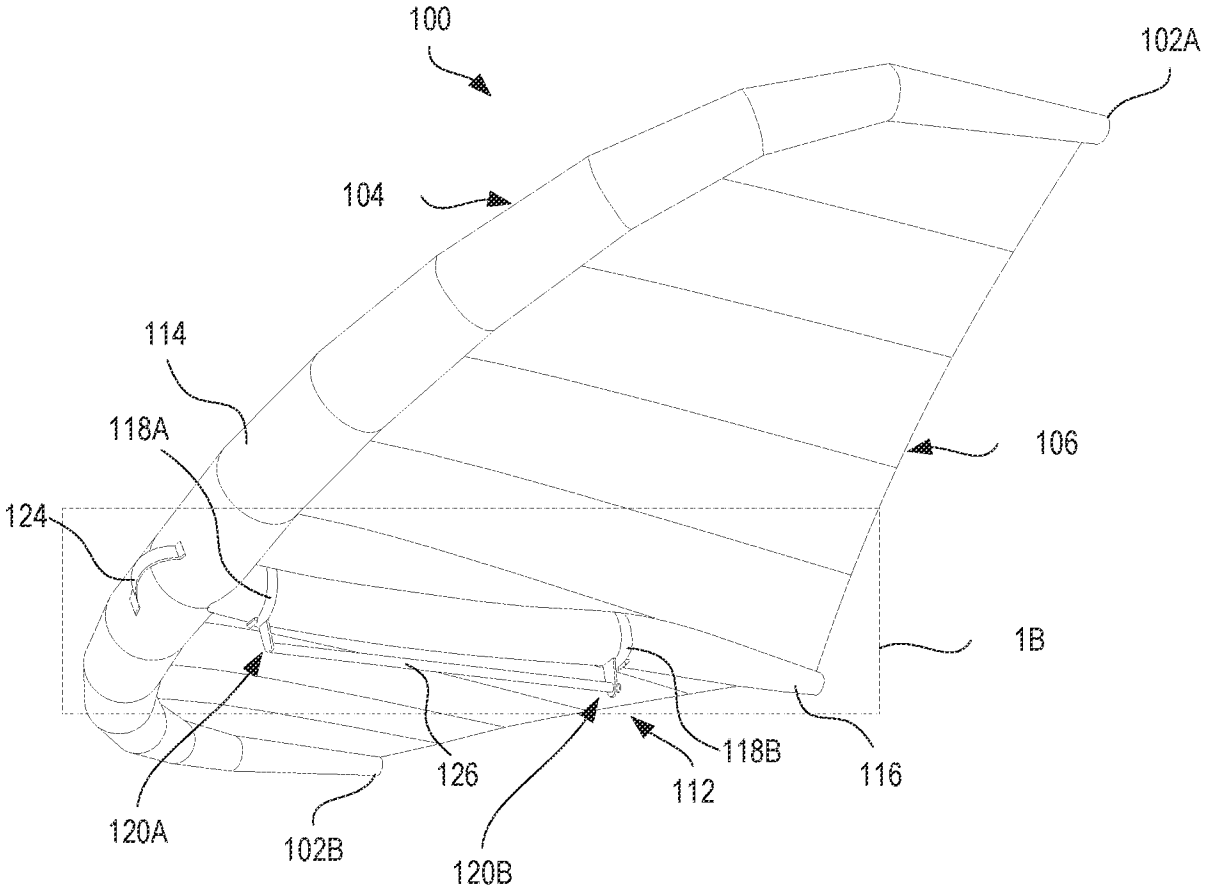
FIG. 1A is a perspective view of a wingsurfing wing, in accordance with the embodiment.

The following disclosure relates to handles for wingsurfing wings, which may be referred to herein as simply "wings". In some embodiments, the devices, kits, assemblies, and methods disclosed herein can facilitate greater operational flexibility of handles, e.g. by allowing a handle to be used with different sizes of wings.

The description generally describes various embodiments of a wing handle, including those for use on an inflatable wing, which may be removable and have a length that is adjustable so that the handle fits on different sized wings. The handle is attached to the wing using one or more attachment fittings, which are components adapted or suited for this purpose. In particular, the handle is thereby held in place on a strut of the wing. The attachment fittings include one or more adjustable fittings that are adjustable for varying a length of a graspable portion of the wing handle and/or the attachment location of the handle to the strut, and potentially one or more non-adjustable, free, and/or sliding fittings. Such adjustable fittings may be slidable via (a member of) the handle passing through the fitting(s) and are adjustable between a first configuration where they can slide and a second configuration where they cannot slide. As referred to herein, "sliding fittings" are not necessarily adjustable between such first and second configurations; they may only be configured for sliding unless locked in-place by other means, such as by frictional engagement with the straps and/or the elongated portion of the strut. In some embodiments, the wing handle may include a fixed fitting on one end and a sliding fitting on the other end that allows the length of the handle to be adjusted by sliding. Advantageously, in some embodiments, an adjustable handle achieved via movable attachment fittings may fit a full line-up of wing sizes.

In various embodiments, the adjustable fittings allow for adjustment by allowing an elongated member of the handle to pass through the fitting by the means of a feature such as, but not limited to a girdle in the form of a slot, hole, or ring that is suitable for surrounding the member. The adjustable fitting may be able to attach only at certain points of the member, or may be able to attach at any point thereon. The adjustable fittings may be permanently attached to the wing, or able to be removed with the handle.

In various embodiments, the fittings may allow the handle to move freely, or may have a feature which allows for it to lock the handle into position, e.g. by the means of a feature such as, but not limited to, a friction based locking mechanism. The fitting may not be directly attached to the handle and/or may be able to lock onto the handle. One of the adjustable fittings may be a locking adjustable fitting, wherein the handle is locked via a friction-based locking mechanism, which may achieve locking via engagement of one or more locking edges by the fitting as it is rotated into position and/or via a mechanism built into the fitting. Such an adjustable fitting may subsequently be movable or configurable, by rotating it so that the locking edges disengage contact with the handle, to allow it to then move fore and aft along the handle.

In various embodiments, the wing may have a front grip on a tube of the wing at a leading edge thereof (leading edge tube of the wing). The front grip may be also referred to as the front handle of the wing. The wing handle may attach to the front grip and/or either side thereof, and to the front section of the handle on the strut. The wing handle may be flexible or rigid and may have at least one removable attachment or a permanently attached attachment. In some embodiments, the removable wing handle has a curved front section that connects to the front handle on the leading edge tube of the wing and connects to the strut using two or more adjustable or slidable fittings, using one or more sliding fittings and one or more adjustable fittings, or using two or more fixed attachments.

In various embodiments, the handle attaches to the front handle on the leading edge tube via a front section of the handle. The front section of the handle may attach to the front of the leading edge tube, on either side of the front handle and to the front section of the handle on the strut. This front section may be flexible or rigid and may have at least one removable attachment or be permanently attached to the front grip.

It is conceived that, in various embodiments, advantages described herein may be achieved using wing handles; wings equipped with wing handles; wing kits including the wing handle, the wing, and/or components connecting the two; adjustable fittings that may be coupled with existing handles; and/or via implementations of methods described herein.

Aspects of various embodiments are now described in relation to the figures.

In this description, various embodiments of a numbered part are generally referred to using the same reference numeral. However, in cases where distinguishing of particular embodiments is felt to improve the presentation and comprehension, unless otherwise noted, the first digit of the reference numeral of the numbered part is be varied. For example, a larger wing 100 may thereby be distinguished from a smaller wing 200.

FIG. 1A is a perspective view of a wingsurfing wing 100, in accordance with the embodiment.

Figure 1B:
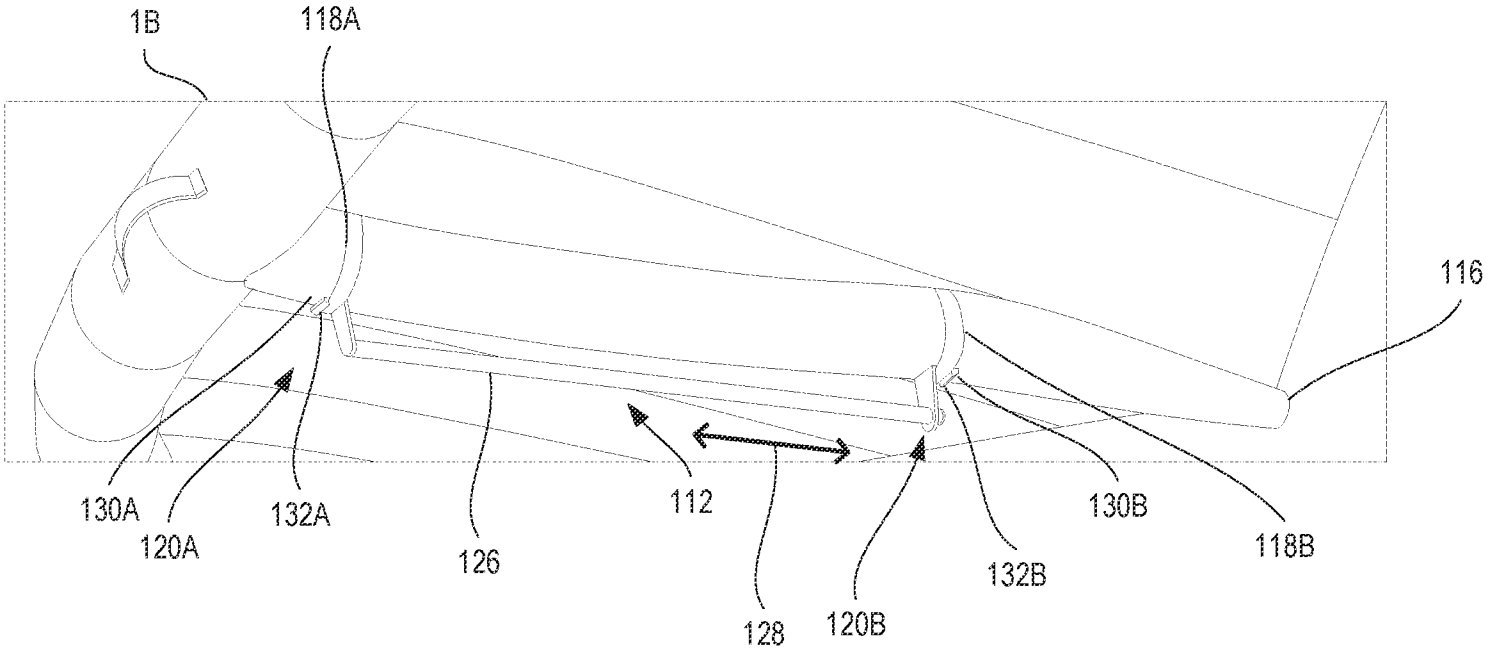
FIG. 1B is an enlarged view of region 1B in FIG. 1A.

FIG. 1B is an enlarged view of region 1B in FIG. 1A.

The wing 100 extends between wingtips 102A, 102B situated at opposite lateral sides of the wing 100, and also between a leading edge portion 104 and a trailing edge portion 106 of the wing 100.

The wing 100 is generally inflatable. For example, the wing 100 may be fully inflatable or one or more components thereof may be inflatable. The wing 100 may be constructed using a fabric such as nylon or polyester.

As shown in the embodiment of FIGS. 1A-1B, the leading edge portion 104 is defined by a leading edge tube 114, which forms a structural frame for the wing 100 together with a strut 116 of the wing 100. The leading edge tube 114 extends around a front of the wing 100 and forms a curved or arcuate shape to simultaneously define or extend till the wingtips 102A, 102B. The strut 116 extends generally longitudinally between the laterally spaced apart wingtips 102A, 102B from the leading edge portion 104 to the trailing edge portion 106 (i.e. therebetween). The strut 116 may generally be straight.

In various embodiments, the leading edge tube 114 and/or the strut 116 may be inflatable to form a relatively inflexible or rigid frame. The remaining body of the wing 100 may not be inflatable. For example, fabric may be attached to the leading edge tube 114 at a rearward side thereof and to the strut 116 such that the fabric extends tautly therebetween to form a lifting surface.

In the embodiment of FIGS. 1A-1B, the wing 100 includes a front grip 124 or front handle. The front grip 124 is fixedly attached to the wing 100, and in particular, the leading edge tube 114. For example, the front grip 124 may be sown on to or adhesively attached to a front of the leading edge tube 114. The front grip 124 facilitates carrying and handling of the wing 100.

A handle 112 (a wingsurfing handle) is removably installed or mounted on the wing 100 and includes front and rear attachment portions 132A, 132B that are suitable for attaching a member 126 of the handle 112 to the strut 116. The member 126 is elongated in an elongation direction 128, connected to the strut 116, and is spaced apart from the strut 116 to be suitable for grasping by a user during use of the wing 100. In general, the member 126 is connected, directly or indirectly, to the strut 116 at at least one location of the strut 116 and is connect via a fitting, which extends from the member 126, at another location of the strut 116 spaced apart from the at least location in the elongation direction 128. The wing 100 is manipulable by the user via the member 126 of the handle 112. As referred to herein, the elongation direction 128 may be oriented towards the leading edge or the trailing edge, and as such is indicated with a double-headed arrow in FIG. 1B.

In the embodiment of FIGS. 1A-1B, the member 126 is a rod or tube, which runs along the strut 116. In some embodiments, the member 126 may also extend past the strut 116 and extend around the leading edge portion 104, or may be integrally coupled with a curved portion that extends past the strut and around the leading edge portion 104, as will be described later. In general, the member 126 facilitates grasping by a user and also movable or slidable engagement with the fittings 120A, 120B. Structures other than a rod or tube may achieve similar objectives. For example, in some embodiments, the member 126 may include a sliding portion and another grasping portion that includes notches or apertures for receiving fingers (or parts thereof) of a user.

One or more fastening portions are attached to an elongated portion of the strut 116 at separate locations 130A, 130B of elongated portion of the strut 116. The fastening portions are adapted for attaching the handle 112 to the strut 116 by coupling with front and rear attachment portions 132A, 132B of the handle 112. As shown FIGS. 1A-1B, the fastening portions may include straps 118A, 118B, e.g. webbing attachments, which may include hook and loop fasteners. In some embodiments, the fastening portions may include one or more fasteners allow fastening to both the strut 116 and the handle 112.

As shown in the embodiment of FIGS. 1A-1B, the handle 112 is removably attached to the straps 118A, 118B on the strut 116 at the locations 130A, 130B of the strut 116. The handle 112 is so attached via a front fitting 120A, located near the leading edge tube 114, defining the front attachment portion 132A, and a rear fitting 120B defining the rear attachment portion 132B. The front and rear attachment portions 132A, 132B extend from the member 126. The rear attachment portion 132B is spaced apart in the elongation direction 128 from the front attachment portion 132A.

The attachment portions 132A, 132B (and hence fittings 120A, 120B) are complementary to the fastening portions to allow coupling of the strut 116 to the fastening portions described earlier. In some embodiments, the fastening portions are engageable with one or more of the fittings 120A, 120B to connect the member 126 to the strut 116 at the locations 130A, 130B via the respective fittings 120A, 120B. At least one of the fastening portions may be movable relative to elongated portion of the strut 116 to vary the one or more of the locations 120A, 120B in an initial configuration. For example, the straps 118A, 118B may be suitable for at least partially circumferentially surrounding the elongated portion of the inflatable strut 116 such that inflation of the inflatable strut 116 causes pressing of the straps 118A, 118B over the inflatable strut 116 for attachment of the straps 118A, 118B to the respective locations 130A, 130B by frictional engagement between the straps 118A, 118B and the strut 116. As such, the straps 118A, 118B may be movable to vary the location 130A, 130B when the strut 116 is not fully inflated, and may be substantially immovable relative to the elongated portion of the strut 116 when the strut 116 is fully inflated, due to frictional engagement between the straps 118A, 118B and the strut 116.

In the embodiments of FIGS. 1A-1B, the attachment portions 132A, 132B comprise respective channels that couple with the straps 118A, 118B, as will now be described. The straps 118A, 118B are complementary to the channels of the respective attachment portions 132A, 132B; they are suitable for being received into and retained therein by the channels to attach the attachment portions 132A, 132B to the wing 100. For example, a width of the straps 118A, 118B may be sized based on the width of the channels. In various embodiments, the straps 118A, 118B may have a width substantially equal to the width of the channels to facilitate a snug fit therein. The attachment portions 132A, 132B may be hooked onto the straps 118A, 118B. The channels open downwards such that the straps 118A, 118B apply a force against a base of the channel. The channels are adapted to receive and frictionally retain the straps 118A, 118B to connect the member 126 to the strut 116. For example, the base of the channels may be adapted by being arcuate, curved and/or having specialized surfaces to achieve frictional engagement between the straps 118A, 118B and the channels to prevent movement of the straps 118A, 118B relative to the elongated portion of the strut 116. The channels are sandwiched (in a sandwich connection) between the respective straps 118A, 118B and the elongated portion of the strut 116, which causes pressing of the channels against the straps 118A, 118B when the straps 118A, 118B press against the elongated portion of the strut 116. In this manner, inflation of the elongated portion of the strut 116 causes tightening of the sandwich connection between the straps 118A, 118B, the respective channels, and the elongated portion of the strut 116 to promote or increase frictional engagement between parts of the connection. The channels are spaced apart from the member 126 to space the member 126 apart from the strut 116 to allow grasping of the member 126 while the attachment portions 132A, 132B are attached to the wing 100.

As will be explained further, in the embodiment of FIGS. 1A-1B, the fitting 120A at the front is fixed (or fixed fitting), while the fitting 120B at the rear is adjustable (an adjustable fitting). In particular, the adjustable fitting 120B is adjustable between a first configuration and a second configuration. When the fitting 120B is configured in accordance with the first configuration, the fitting 120B is movably engaged with the member 126 to reposition the rear attachment portion 132B relative to the front attachment portion 132A in the elongation direction 128. Movable engagement of the fitting 120B with the member 126 allows movement of the fitting 120B in the elongation direction 128 to vary the location 130B where the handle 112 attaches to the strut 116 via the rear attachment portion 132B. When the fitting 120B is configured in accordance with the second configuration, the fitting 120B is fixedly engaged with the member 126 (e.g. by frictional engagement) to hold the attachment portions 132A, 132B fixed relative to each other, and/or (or at least) to hold the fitting 120B fixed relative to the member 126.

In some embodiments, as will be discussed later, the fitting 120A may not be fixed but may also be adjustable and configurable or operable to achieve a locked or non-moving position; fittings 120A, 120B may then both be adjustable fittings, and each may be adjustable from a respective first configuration to a respective second configuration. In some embodiments, instead of attachment to the strut via the fixed fitting 120A, the member 126 may be attached directly to strut 116 at the location 130A.

In various embodiments, a strut of a wingsurfing wingcan vary between 2 to 7.5 m.

Figure 2:
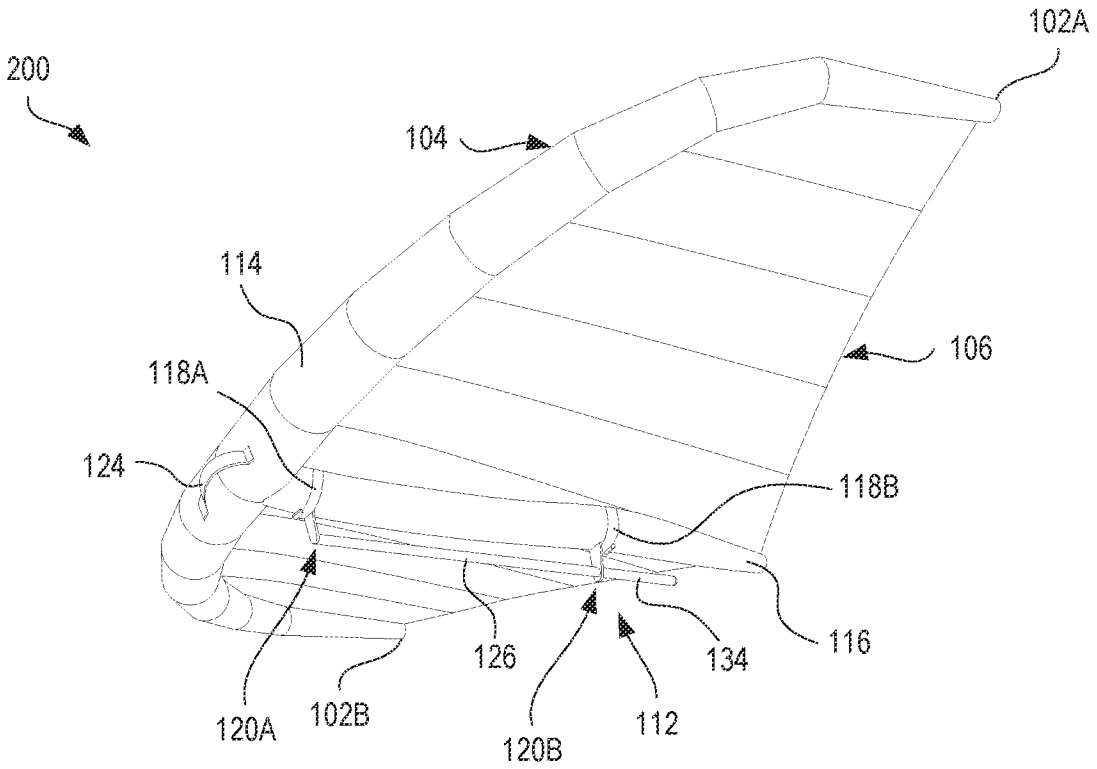
FIG. 2 is a perspective view of a small wingsurfing wing, in accordance with the embodiment.

FIG. 2 is a perspective view of a small wingsurfing wing 200, in accordance with the embodiment.

The wingsurfing wing 100 of FIGS. 1A-1B and the small wingsurfing wing 200 of FIG. 2 are hand held wings with differently sized struts. The elongated portion of the strut 116 may vary depending on the wingspan. However, since the fitting 120B is adjustable, the handle 112 can be flexibly used in either case by appropriate adjustment of the fitting 120B.

In FIG. 2, the adjustable fitting 120B is adjusted to bring it closer to the fixed fitting 120A to form a cantilevered section 134 and to allow the handle 112 to be used for the small wingsurfing wing 200.

In an example procedure, the fittings 120A, 120B are brought sufficiently closer to each other by movement in the elongation direction along the member 126 to match the locations of the straps 118A, 118B. In some cases, the straps 118A, 118B may also be adjusted. The fittings 120A, 120B are then engaged with the straps 118A, 118B by receiving the straps 118A, 118B into respective channels of the fittings 120A, 120B. The strut 116 is then inflated to achieve a tight frictional fit (interference fit) between the straps 118A, 118B, the fittings 120A, 120B, and the wing 200.

Figure 3A:
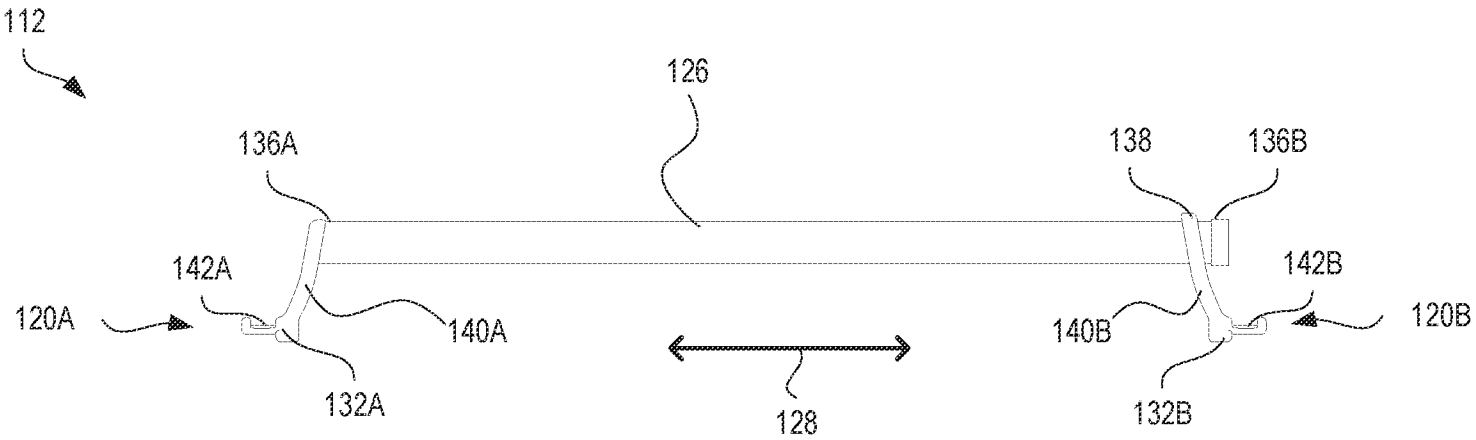
FIG. 3A is a side elevation view of the handle with its adjustable fitting configured for a large wing, in accordance with an embodiment.

FIG. 3A is a side elevation view of the handle 112 with its adjustable fitting configured for a large wing, in accordance with an embodiment.

Figure 3B:
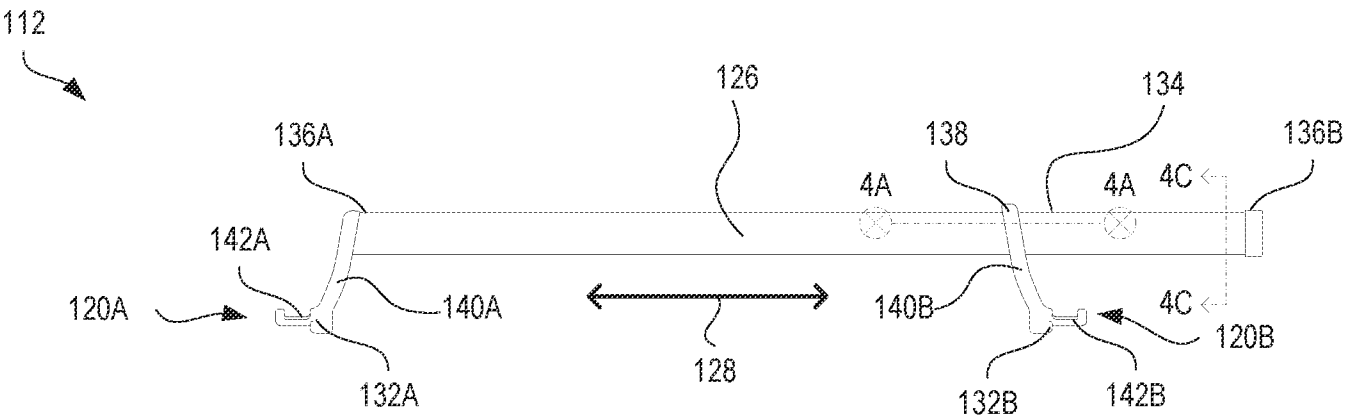
FIG. 3B is a side elevation view of the handle with its adjustable fitting configured for a small wing, in accordance with an embodiment.

FIG. 3B is a side elevation view of the handle 112 with its adjustable fitting configured for a small wing, in accordance with an embodiment.

As shown in FIGS. 3A-3B, the member 126 extends between opposite ends 136A, 136B thereof in the elongation direction 128. The fittings 120A, 120B are connected to the member 126. The front fitting 120A is positioned at the end 136A of the member 126 and may be fixed in that position, while the rear fitting 120B may be adjustable to vary its position along the member 126. In FIG. 3A, the rear fitting 120B is positioned near the end 136B of the member 126.

In the embodiment of FIGS. 3A-3B, the handle 112 includes a portion 138 of the fitting 120B is dimensioned based on the member 126 to slidably receive the member 126 for slidable engagement of the fitting 120B with the member. This allows movement of the fitting 120B relative to the member when the fitting 120B is configured in accordance with the first configuration of the fitting 120B. The portion 138 includes a girdle or an aperture that defines such a girdle. The girdle is attached to the first attachment portion and is adapted to slidably receive the member 126 therein to slidably engage with the member 126. During slidable engagement of the girdle with the member 126, movement of the girdle along the member 126 allows repositioning of the fitting 120B in the elongation direction 128 relative to the fitting 120A. The fitting 120A, on the other hand, remains fixed in position, and so does not a have girdle suited for slidable engagement and a portion defining such a girdle.

In various embodiments, the girdle is a ring, a non-circular ring, a quadrate or other shaped opening (e.g. a quadrated aperture) formed in a plate or bar, or a plurality of arcuate portions cooperating with each other. In various embodiments, the girdle is adapted or dimensioned according to the member 126 and a cross-section thereof created by a plane substantially perpendicular to the elongation direction, or direction of sliding, of the member 126 such that the girdle achieves a sliding fit with the member 126.

As shown in FIGS. 3A-3B, the fittings 120A, 120B define respective legs 140A, 140B extending from adjacent the member 126 and away from the member 126. The legs 140A, 140B end in the attachment portions 132A, 132B and thereby space the attachment portions 132A, 132B away from the member 126. For example, the legs 140A, 140B may be angled away from the member 126. The attachment portions 132A, 132B define their respective channels 142A, 142B. The channels 142A, 142B have a base suitable for accommodating the straps 118A, 118B and side walls for retaining the straps 118A, 118B therein. The side walls rise up higher than the base and the base is wider than the side walls. The base of the channels 142A, 142B is up turned such that it faces generally towards the member 126 rather than away from it.

Figure 4B:
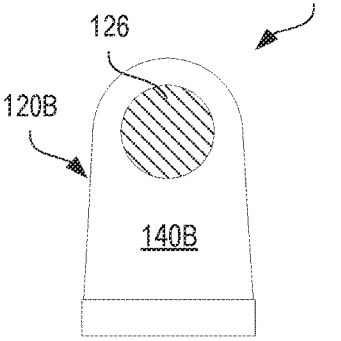
FIG. 4B is a front cross-sectional view of the handle along the section 4B-4B in FIG. 3B, in accordance with an embodiment.
Figure 4A:
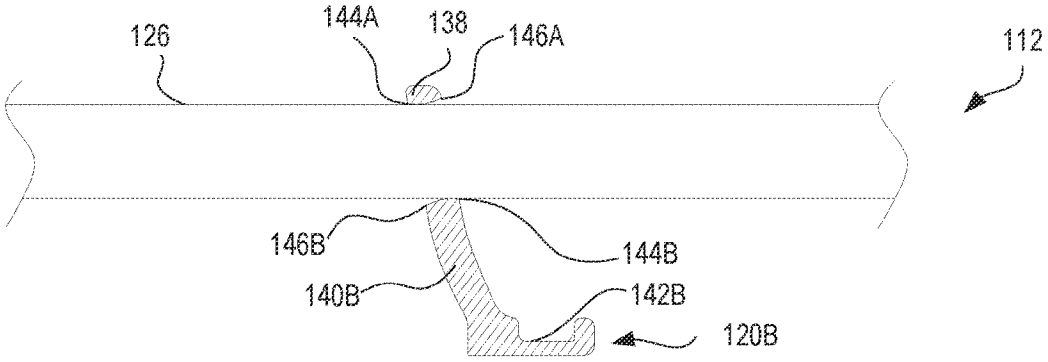
FIG. 4A is a partial cross-sectional view of the handle 112 in a locked configuration along the section 4A-4A in FIG. 3B, in accordance with an embodiment.

FIG. 4A is a partial cross-sectional view of the handle 112 in a locked configuration along the section 4A-4A in FIG. 3B, in accordance with an embodiment.

FIG. 4B is a front cross-sectional view of the handle along the section 4B-4B in FIG. 3B, in accordance with an embodiment.

Figure 4C:
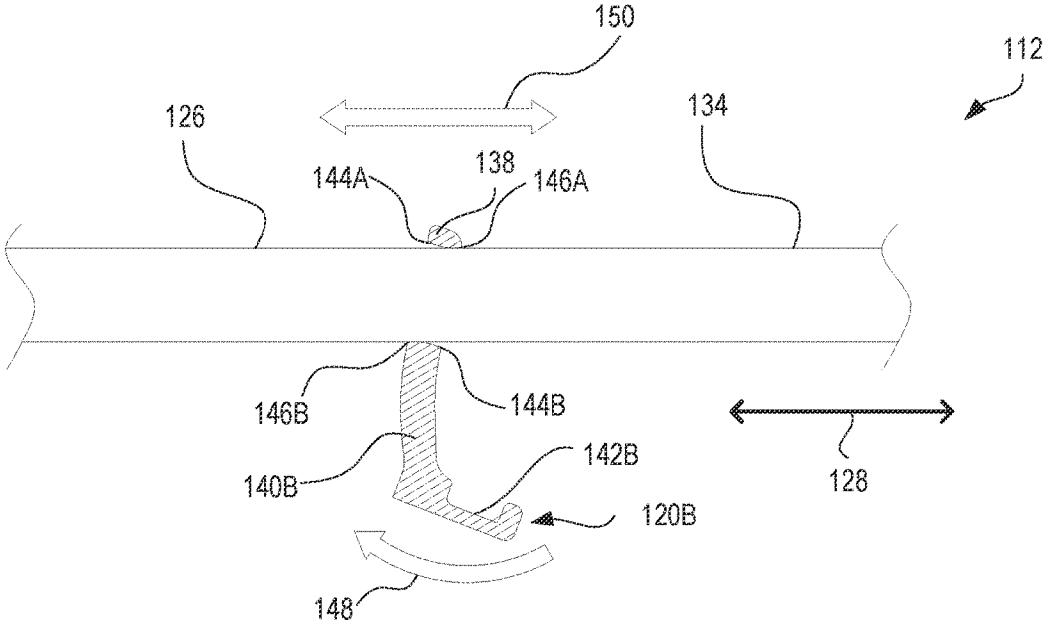
FIG. 4C is a partial cross-sectional view of the handle in a movable configuration along the section 4A-4A in FIG. 3B, in accordance with an embodiment.

FIG. 4C is a partial cross-sectional view of the handle 112 in a movable configuration along the section 4A-4A in FIG. 3B, in accordance with an embodiment.

As shown in FIGS. 4A-4C, in the locked configuration, the adjustable fitting 120B is in a locked position, wherein locking edges 144A, 144B defining one or more frictional surfaces are facing and contacting the member 126. For example, frictional surfaces may include high friction polyurethane surfaces. The movable configuration or sliding position of the adjustable fitting 120B is achieved by a rotation 148 of the adjustable fitting 120B or the portion 138 thereof (or a girdle thereof) relative to the member 126 from the locked configuration. This involves rotating one or more slipping surfaces defined by the slip edges 146A, 146B on to the member 126 to allow sliding of the fitting 120B relative to the member 126 while supporting the fitting 120B on the member 126. This disengages the locking edges 144A, 144B and in turn engages the slip edges 146A, 146B. The one or more slipping surfaces face and contact the member 126 in the movable configuration to allow movement 150 of the adjustable fitting 120B fore or aft along the member 126. A rotation opposite to the rotation 148B allows reconfiguration from the movable configuration to the locked configuration. Such a rotation involves rotating the one or more frictional surfaces on to the member 126. Pushing the one or more frictional surfaces into the member 126 causes frictional engagement of the fitting 120B with the member 126 to prevent movement of the fitting 120B relative to the member 126.

In some embodiments, the strut 116 may not be inflated in the movable configuration and may be inflated in the locking configuration.

The one or more frictional surfaces of the locking edges 144A, 144B extend radially inwardly, e.g. from the girdle or the portion 138, to frictionally engage the member 126 to hinder or prevent slidable engagement with the member 126 when the adjustable fitting 120B is in the locked configuration.

In various embodiments, the frictional surfaces may include surfaces configured to generate sufficient frictional force to prevent movement of the fitting 120B when pulled by a user. The frictional surfaces may be curved or angled (non-perpendicularly) relative to the member 126 at the contact surfaces (or contact points or locations) of the frictional surface with the member 126 such that a force generally parallel to the elongation direction 128 has a component in a direction normal to the frictional surface at the location(s) where the frictional surfaces contact the member 126. Frictional forces may generally be dependent on the roughness of the surface and/or other properties, and may increase with increasing normal force (at the contact surface). With sufficiently high roughness and/or other properties that increase friction, a frictional force may be sufficient to prevent movement by a user.

Figure 5:
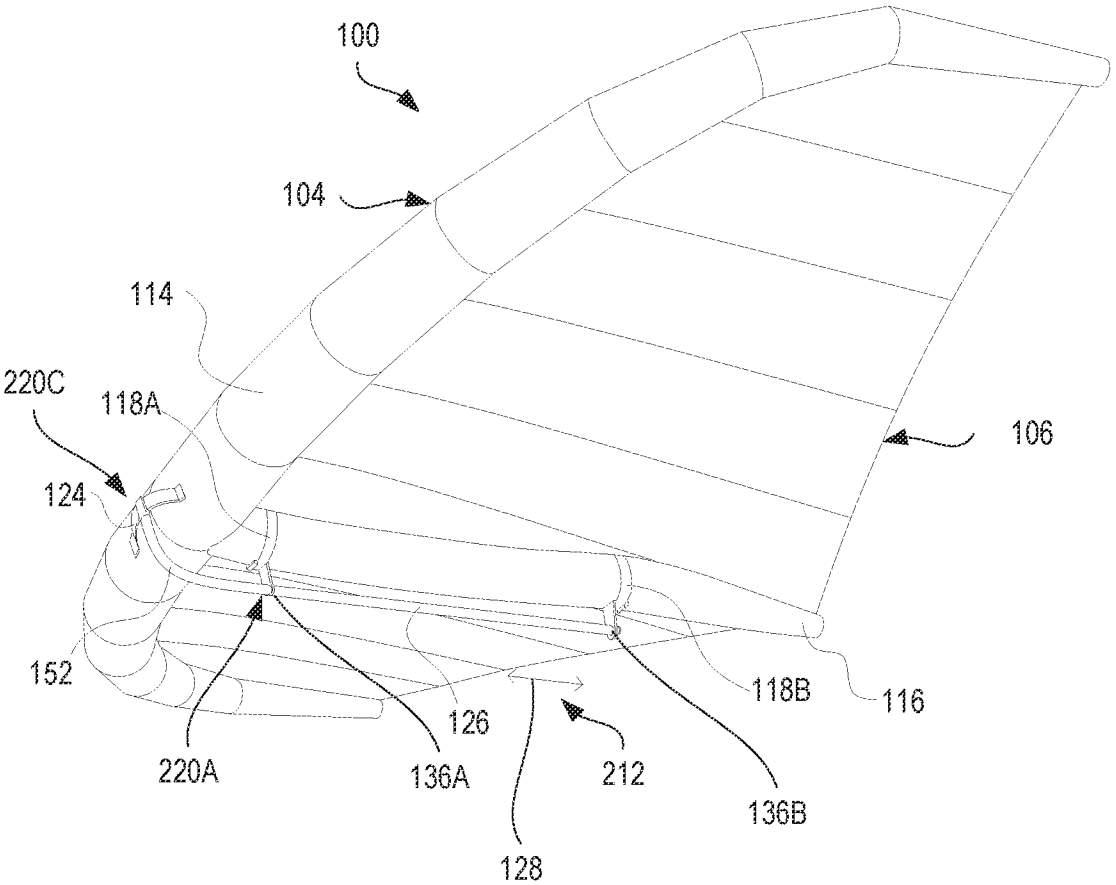
FIG. 5 is a perspective view of the wing equipped with a handle with a curved front section, in accordance with an embodiment.

FIG. 5 is a perspective view of the wing 100 having a handle 212 with a curved front section, in accordance with an embodiment.

Compared to previously presented handles 112, the handle 212 in FIG. 5 is not a straight. Namely, the curved front section is (e.g. removably) attached to the strap 118A (or webbing attachments) and front grip 124 (or front handle) on the leading edge tube 114 and is also attached using a plurality of adjustable fittings.

In the embodiment of FIG. 5, the handle 212 includes a curved portion 152 integrally formed or is in unitary construction with the member 126. For example, the curved portion 152 may be a curved member, such as a curved rod or tube. The curved portion 152 extends from the member 126 at the end 136A of the member 126 in the elongation direction 128. The curved portion 152 may facilitate handling of the wing, which may otherwise be difficult, e.g. when the wing is not in use.

The curved portion 152 is adapted, e.g. dimensioned or generally shaped, to extend from under the strut 116 to in front of a leading edge portion of the wingsurfing wing 100.

The handle 212 includes three fittings 220A, 220B, 220C instead of two fittings as in the handle 112 of FIG. 2. The fitting 220C is frontmost compared to the other fittings 220B, 220C and is formed at an end of the curved portion 152.

The curved portion 152 defines a third attachment portion extending from the curved portion 152. The third attachment portion is suitable for fixedly attaching the curved portion 152 to the leading edge portion 104. In the embodiment of FIG. 5, the third attachment portion includes a channel for receiving the front grip 124, or a strap thereof.

The fitting 220C defines a corresponding attachment portion extending from the member 126 and being suitable for fixedly attaching the member 126 to the wing 100.

Figure 6:
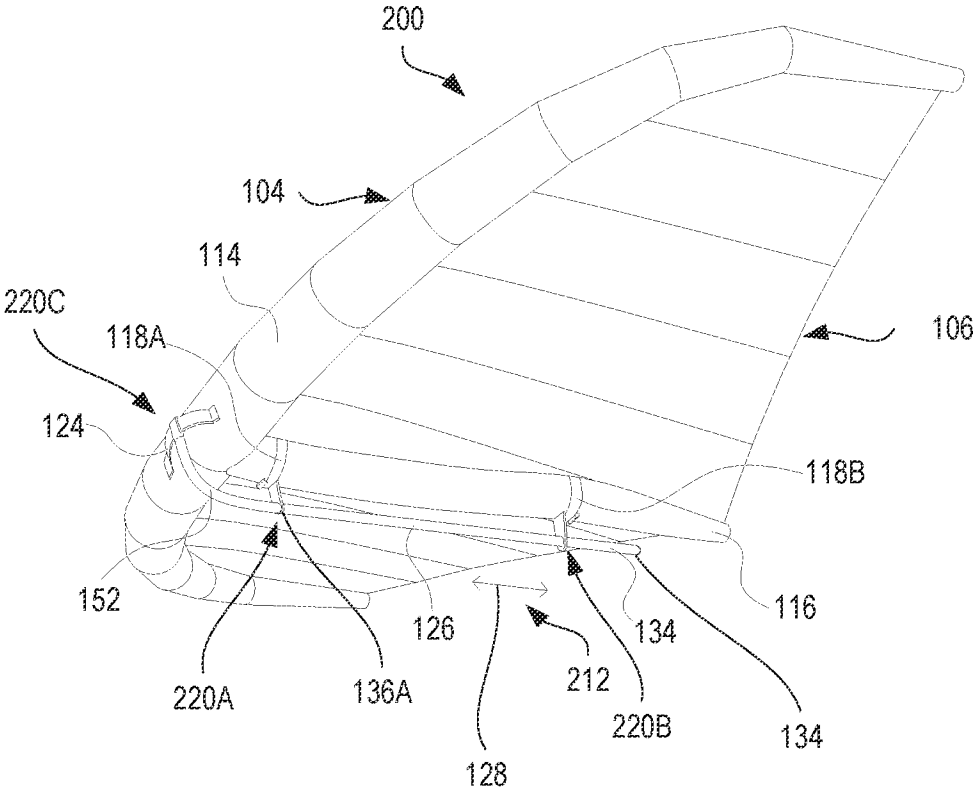
FIG. 6 is a perspective view of the smaller wing equipped with the handle with the curved front section, in accordance with an embodiment.

FIG. 6 is a perspective view of the smaller wing 200 having the handle 212 with the curved front section, in accordance with an embodiment.

As shown in FIG. 6, installing the handle 212 on the smaller wing 200 involves moving the rear fitting 220B towards the leading edge portion 104 such that the cantilever 134 is formed or extended. This brings the fittings 220A, 220B, 220C closer to each other.

Figure 7A:
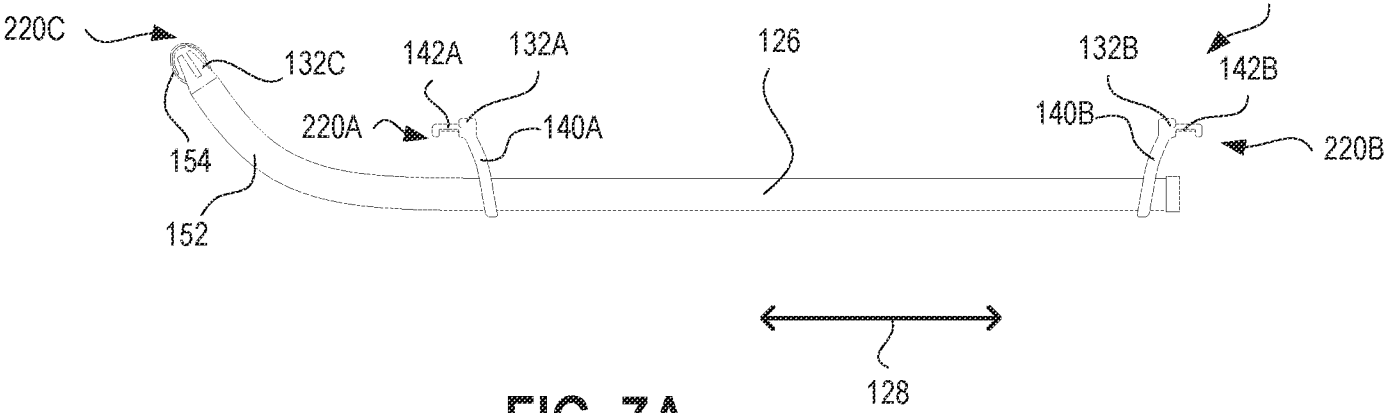
FIG. 7A a side elevation view of the handle with its adjustable fitting configured for a large wing, in accordance with another embodiment.

FIG. 7A a side elevation view of the handle 212 with its adjustable fitting configured for a large wing, in accordance with another embodiment.

Figure 7B:
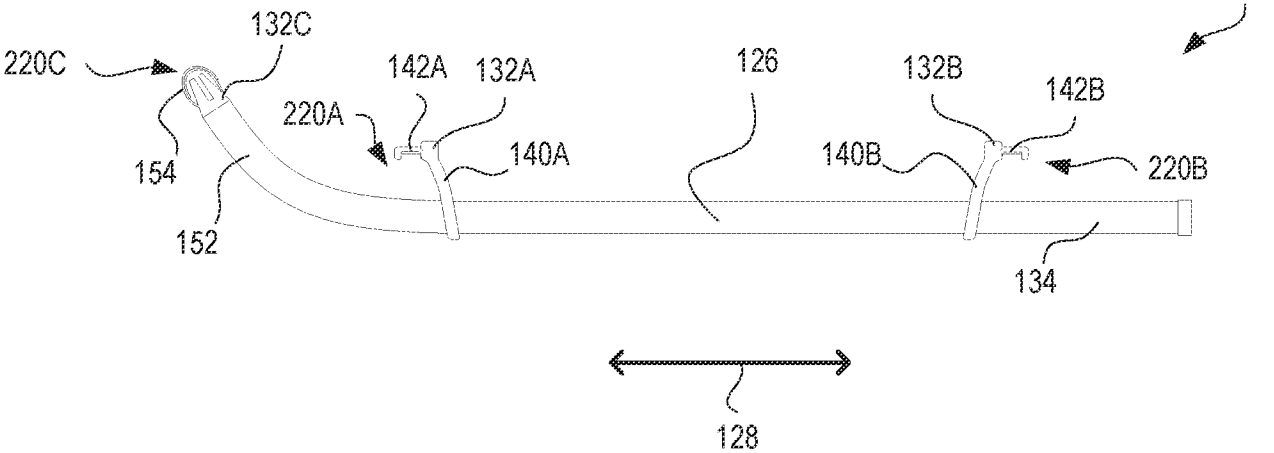
FIG. 7B a side elevation view of the handle of FIG. 7A with its adjustable fitting configured for a small wing.

FIG. 7B a side elevation view of the handle 212 of FIG. 7A with its adjustable fitting configured for a small wing.

In FIGS. 7A-7B, both the rearmost fitting 220B fitting and the middle fitting 220A are adjustable fittings to vary their position along the member 126, while the frontmost fitting 220C is fixed in position and cannot be moved along the member 126. The front fitting 220A has an attachment portion 132C. The attachment portion 132C is a slot, slit or channel suitable for receiving a strap of the grip 124.

In the embodiment of FIGS. 7A-7B, the attachment portion 132C is a slot that opens at least partially away from the member 126. A retainer 154 may be engaged with the fitting 220C so as to retain the front grip 124 (or a portion thereof) within the slot defined by the attachment portion 132C.

An example method of installing the handle 212 of FIGS. 7A-7B includes attaching the curved member 152 to the wing via the attachment portion 132C and the front grip 124 by sliding a strap of the front grip 124 into the slot or channel defined by the attachment portion 132C, attaching the member 126 to the curved member 152 is not already attached (such as by unitary construction therebetween), and then attaching the member 126 to the wing via the attachment portions 132A, 132B. As described earlier, inflation of the wing and/or strut 116 facilitates tightening and frictional engagement between connecting components to achieve a tight fit.

The fittings 220A, 220B have been adjusted so that member 126 fits on to the straps 118A, 118B on the strut 116 thus creating a cantilever section.

Figure 8A:
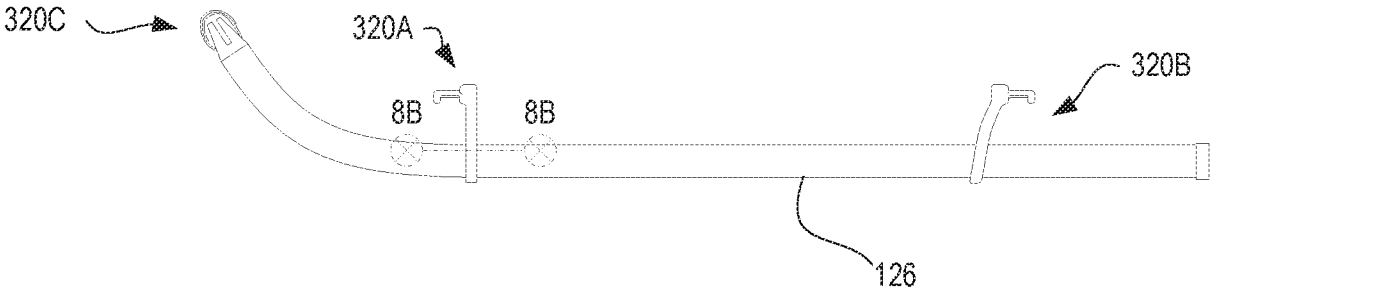
FIG. 8A is a side elevation of a handle, in accordance with yet another embodiment.

FIG. 8A is a side elevation of a handle 312, in accordance with yet another embodiment.

Figure 8B:
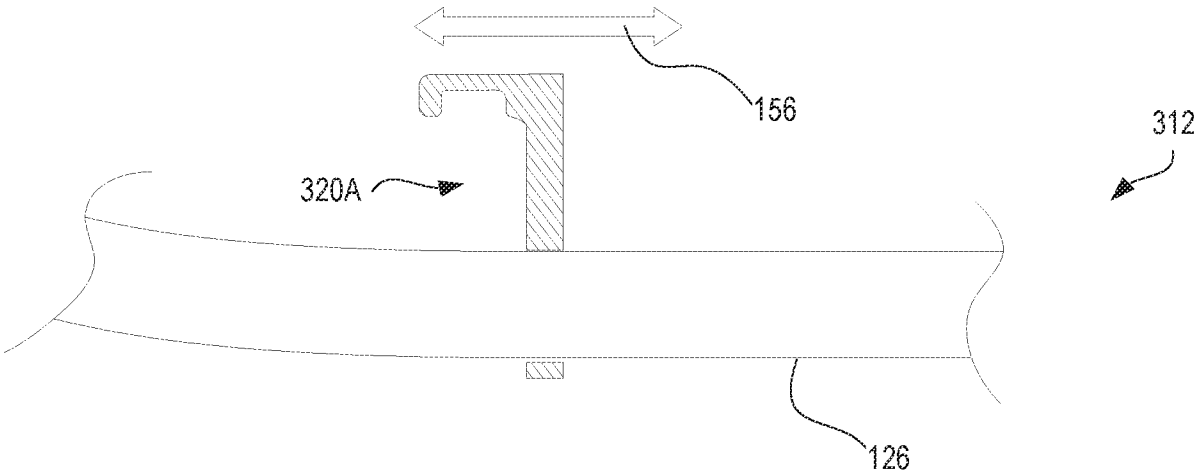
FIG. 8B is a cross-sectional view of the handle of FIG. 8A along the section 8B-8B in FIG. 8A.

FIG. 8B is a cross-sectional view of the handle 312 of FIG. 8A along the section 8B-8B in FIG. 8A.

The handle 312 of FIG. 8A may be substantially similar to the handle 212 of FIGS. 7A-7B and may include three fittings 320A, 320B, 320C. The middle fitting 320B in FIG. 8A is a sliding fitting and is free to slide along the member 126 and/or the curved member 152 as indicated by the sliding movement 156 illustrated in FIG. 8B, e.g. for providing (additional) support. For example, the middle fitting 320B may not comprise one or more locking edges to lock the fitting 320B into places. However, as the strut 116 is inflated, the middle fitting 320B may lock into place and/or may self-correct or self-position to achieve an appropriate fit with the corresponding strap 118B.

The fitting 320B may define a girdle for slidably receiving the member 126 thereinto and for allowing sliding.

Figure 9:
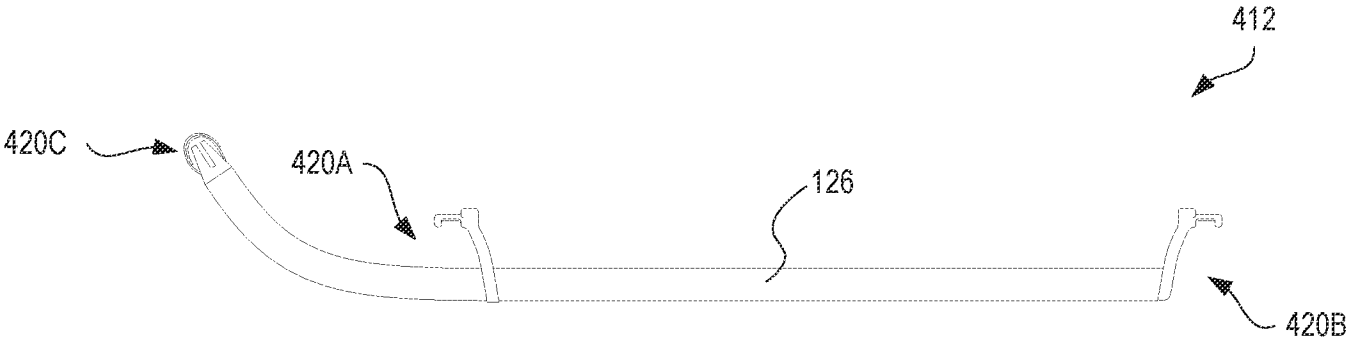
FIG. 9 is a side elevation of a handle, in accordance with yet a further embodiment.

FIG. 9 is a side elevation of a handle 412, in accordance with yet a further embodiment.

The handle 412 of FIG. 9 may be substantially similar to the handle 212 of FIGS. 7A-7B and may include three fittings 420A, 420B, 420C. The frontmost fitting 420A and the rearmost fitting 420C in FIG. 9 are both fixed fittings, i.e. their position is fixed and cannot be varied. However, the position of the middle fitting 420B may be varied as this is adjustable.

Figure 10:
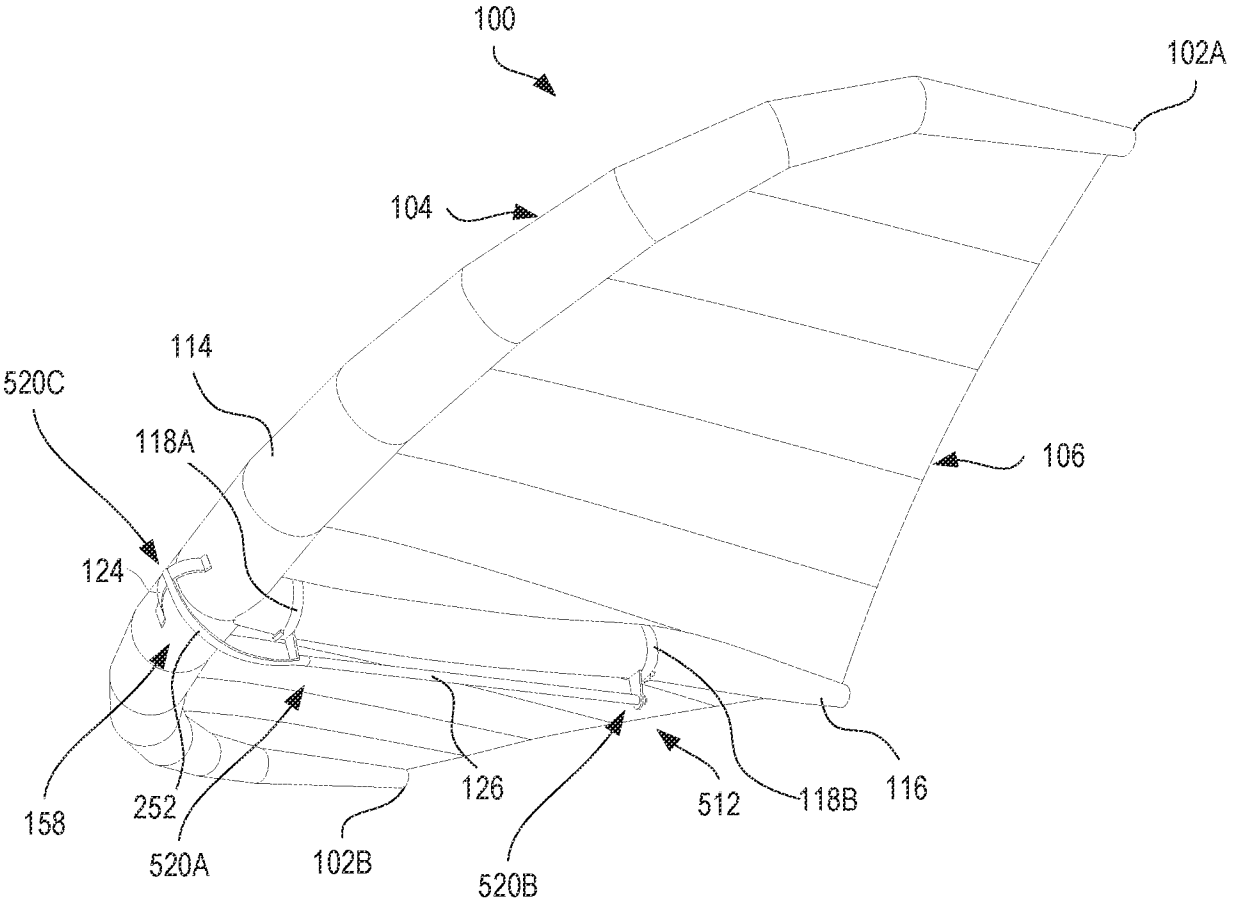
FIG. 10 is a perspective view of the wing equipped with a handle, in accordance with a further embodiment.

FIG. 10 is a perspective view of the wing 100 having a handle 512, in accordance with a further embodiment.

The handle 512 of FIG. 10 includes three fittings 520A, 520B, 520C. The front two fittings 520A, 520B are fixed and are part of a single component 158 of unitary construction which is coupled to or integrally coupled to the member 126. The component defines a curved member 252. The curved member 252 may be rigid and flat.

Figure 11:
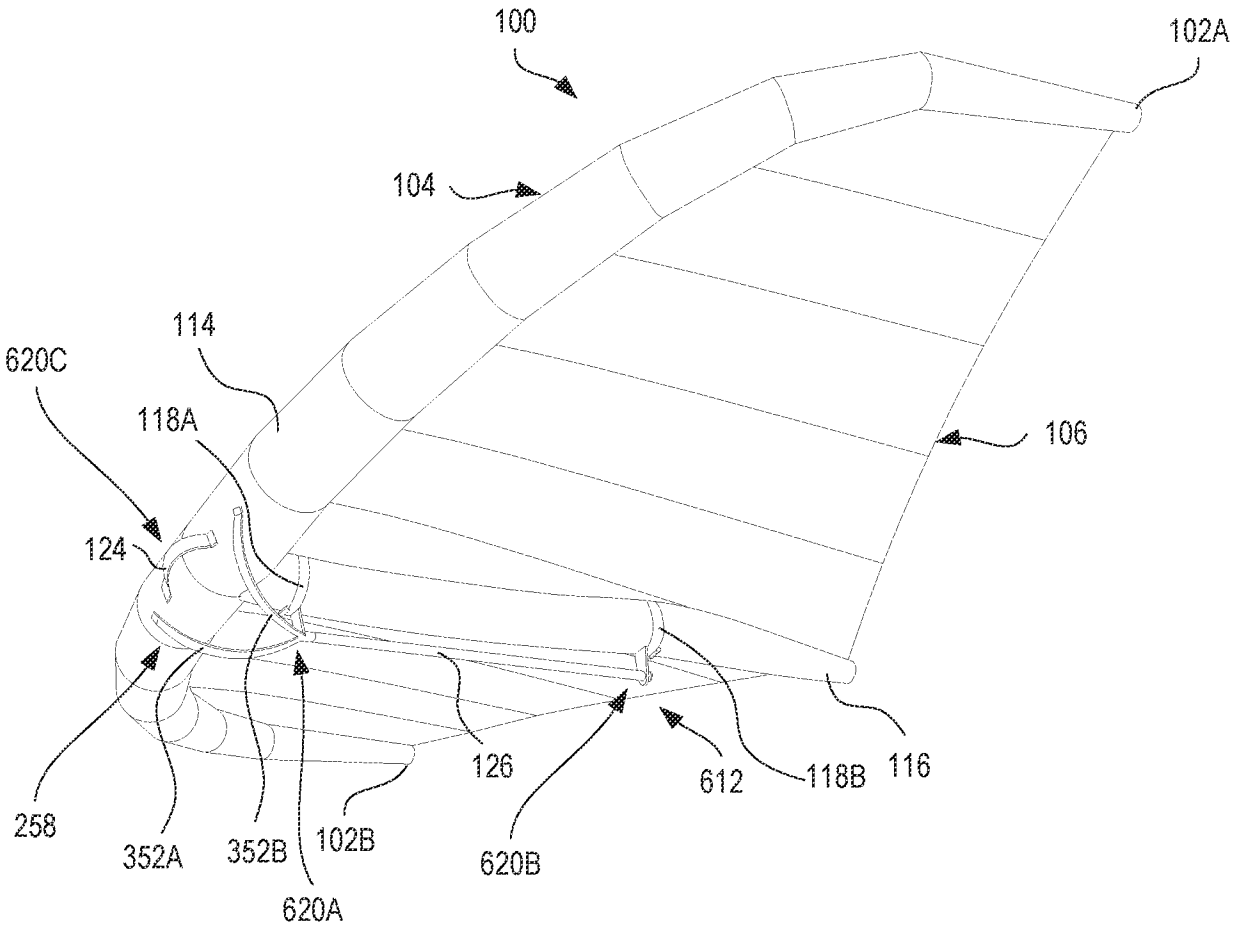
FIG. 11 is a perspective view of the wing equipped with a handle, in accordance with another embodiment.

FIG. 11 is a perspective view of the wing 100 having a handle 612, in accordance with another embodiment.

The handle 612 of FIG. 11 may be substantially similar to the handle 512 of FIG. 10 and may include three fittings 620A, 620B, 620C. The front two fittings 620A, 620B are fixed and are part of a single component 258 of unitary construction which is coupled to or integrally coupled to the member 126. The component defines two curved members 352A, 352B, each of which may be rigid and flat.

Figure 12:
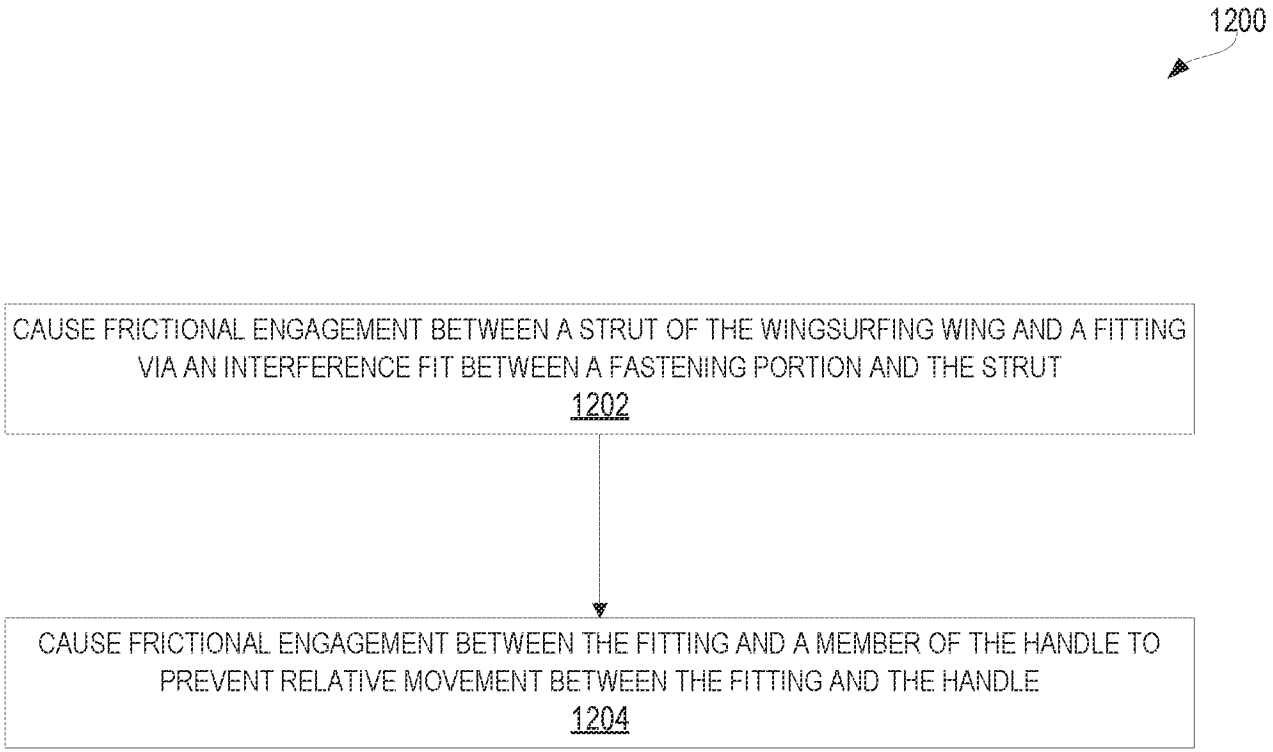
FIG. 12 is a flowchart of a method of retaining a handle of a wingsurfing wing, in accordance with an embodiment.

FIG. 12 is a flowchart of a method 1200 of retaining a handle of a wingsurfing wing, in accordance with an embodiment.

Step 1202 of the method 1200 includes causing frictional engagement between a strut of the wingsurfing wing and a fitting via an interference fit between a fastening portion and the strut. The fitting is retainably disposed in-between the fastening portion and the strut, the strut being deflatable to remove the interference fit.

Step 1204 of the method 1200 includes causing frictional engagement between the fitting and a member of the handle to prevent relative movement between the fitting and the handle. The fitting is disengageable from the member to allow relative movement between the fitting and the handle.

It is conceived that some embodiments of the handle may be used for non-inflatable, e.g. rigid, wings. In some embodiments, there may be no distinct leading edge tube but simply a leading edge portion. The front grip may placed at this leading edge portion of the wing.

The term "connected" or "coupled to" may include both direct coupling (in which two elements that are coupled to each other contact each other) and indirect coupling (in which at least one additional element is located between the two elements).

As can be understood, the examples described above and illustrated are intended to be exemplary only.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, three or more fittings may be used as long as one of them is fixed (has a fixed position), and attachment portions may be formed without fittings. Yet further modifications could be implemented by a person of ordinary skill in the art in view of the present disclosure, which modifications would be within the scope of the present technology.

What is claimed is:

1. A wingsurfing handle, comprising a member that is elongated in an elongation direction to be suitable for grasping;

a first attachment portion extending from the member; and a fitting defining a second attachment portion that extends from the member and that is spaced apart in the elongation direction from the first attachment portion, the fitting being adjustable between a first configuration and a second configuration, the fitting in the first configuration being movably engaged with the member to reposition the second attachment portion relative to the first attachment portion in the elongation direction, the fitting in the second configuration being fixedly engaged with the member, the first and second attachment portions being suitable for attaching the member to a strut of a wingsurfing wing.

2. The wingsurfing handle of claim 1, wherein the fitting is a second fitting, and further comprising a first fitting defining the first attachment portion, the first fitting being fixedly engaged with the member to hold the first attachment portion fixed relative to the second attachment portion when the second attachment portion is configured in accordance with the second configuration.

3. The wingsurfing handle of claim 1, wherein the fitting is a second fitting, and further comprising a first fitting defining the first attachment portion, the first fitting being adjustable between a first configuration and a second configuration of the first fitting, the first fitting in the first configuration of the first fitting being movably engaged with the member to reposition the first attachment portion relative to the member in the elongation direction, the first fitting in the second configuration of the first fitting being fixedly engaged with the member.

4. The wingsurfing handle of claim 1, wherein the first attachment portion comprises a first channel for receiving a first strap attached to an elongated portion of the strut to attach the first attachment portion to the wingsurfing wing, the second attachment portion comprises a second channel for receiving a second strap attached to the elongated portion of the strut to attach the second attachment portion to the wingsurfing wing, the first and second channels being spaced apart from the member to allow grasping of the member while the first and second attachment portions are attached to the wing.

5. The wingsurfing handle of claim 1, wherein the fitting defines a portion dimensioned based on the member to slidably receive the member for slidable engagement of the fitting with the member to allow movement of the fitting relative to the member when the fitting is configured in accordance with the first configuration of the fitting.

6. The wingsurfing handle of claim 5, wherein the portion includes an aperture adapted to receive the member therein to engage with the member and to allow movement of the member while the aperture is engaged with the member.

7. The wingsurfing handle of claim 1, wherein the first attachment portion is defined by a first fitting, the first fitting being positioned at an end of the member in the elongation direction.

8. The wingsurfing handle of claim 1, wherein the fitting frictionally engages with the member to hold the fitting fixed relative to the member when the fitting is configured in accordance with the second configuration.

9. The wingsurfing handle of claim 8, wherein the fitting is reconfigurable between the first configuration and the second configuration by rotation of the fitting relative to the member, and the fitting includes one or more frictional surfaces that are rotated on to the member by rotation of the fitting when the fitting is reconfigured from the first configuration to the second configuration to frictionally engage the fitting with the member to prevent movement of the fitting relative to the member.

10. The wingsurfing handle of claim 9, wherein the fitting includes one or more slipping surfaces that are rotated on to the member by rotation of the fitting when the fitting is reconfigured from the second configuration to the first configuration to allow sliding of the fitting relative to the member and to support the fitting on the member.

11. The wingsurfing handle of claim 1, further comprising:

a curved portion integrally formed with the member and extending from the member at an end of the member in the elongation direction, the curved portion being adapted to extend from under the strut to in front of a leading edge portion of the wingsurfing wing, the curved portion defining a third attachment portion extending from the curved portion, the third attachment portion suitable for fixedly attaching the curved portion to the leading edge portion.

12. The wingsurfing handle of claim 1, further comprising a third attachment portion extending from the member and being suitable for fixedly attaching the member to the wing, and wherein the first attachment portion is slidably engaged with the member to freely slide thereon.

13. A kit, comprising:

the wingsurfing handle of claim 1, wherein the first attachment portion comprises a first channel, and the second attachment portion comprises a second channel;

a first strap complementary to the first channel and suitable for being received into the first channel;

a second strap complementary to the second channel and suitable for being received into the first channel; and a wing for windsurfing defining an inflatable strut, the first and second straps being suitable for at least partially circumferentially surrounding an elongated portion of the inflatable strut such that inflation of the inflatable strut causes pressing of the first and second straps over the inflatable strut.

14. A wingsurfing wing, comprising:

a leading edge portion;

a trailing edge portion;

a strut extending between the leading edge portion and the trailing edge portion;

a member connected to the strut at a first location of the strut, the member being elongated in an elongation direction and spaced apart from the strut to be suitable for grasping; and a fitting extending from the member and connecting the member to the strut at a second location of the strut spaced apart from the first location in the elongation direction, the fitting being adjustable between a first configuration and a second configuration, the fitting in the first configuration being movably engaged with the member to allow movement of the fitting in the elongation direction to vary the second location, the fitting in the second configuration being fixedly engaged with the member.

15. The wingsurfing wing of claim 14, further comprising:

a fastening portion defined at the second location and engageable with the fitting to connect the member to the strut at the second location via the fitting, the fastening portion being movable to vary the second location.

16. The wingsurfing wing of claim 15, wherein the fastening portion includes a strap, and the fitting includes a channel adapted to receive and frictionally retain the strap to connect the member to the strut.

17. The wingsurfing wing of claim 16, wherein the strap at least partially circumferentially surrounds an elongated portion of the strut at the second location for attachment to the second location, the strap and the elongated portion being adjustable to cause frictional engagement between the strap and the elongated portion to prevent movement of the strap relative to the elongated portion.

18. The wingsurfing wing of claim 17, wherein the strut is inflatable such that inflating the elongated portion of the strut causes pressing of the strap over the elongated portion to achieve frictional engagement between the strap and the elongated portion.

19. An adjustable fitting for a wing handle, the wing handle including a first attachment portion extending from a member that is elongated in an elongated direction, the adjustable fitting comprising:

a first attachment portion suitable for attaching the adjustable fitting to a strut of the wing;

a girdle attached to the first attachment portion and adapted to receive a member of the handle for slidable engagement with the member in a first configuration to allow repositioning of the adjustable fitting relative to a second attachment portion of the handle in an elongation direction, the member being elongated in the elongation direction to be suitable for grasping; and one or more frictional surfaces extending radially inwardly from the girdle to frictionally engage the member to hinder slidable engagement between the girdle and the member when the adjustable fitting is in a second configuration, the girdle being adjustable from the first configuration to the second configuration by rotation of the girdle to push the one or more frictional surfaces into the member of the handle.

20. The adjustable fitting of claim 19, wherein the first attachment portion includes a channel that is suitable for receiving and retaining a strap to attach the adjustable fitting to an elongated portion of the strut, the strap at least partially circumferentially surrounding the elongated portion of the strut.

* * * * *